US010800979B2

(12) United States Patent
Sun et al.

(10) Patent No.: US 10,800,979 B2
(45) Date of Patent: Oct. 13, 2020

(54) NON-SOLVENT ASPHALTENE REMOVAL FROM CRUDE OIL USING SOLID HETEROPOLY COMPOUNDS

(71) Applicant: Saudi Arabian Oil Company, Dhahran (SA)

(72) Inventors: Miao Sun, Dhahran (SA); Faisal M. Melibari, Thuwal (SA); Mohammed A. Al-Daous, Thuwal-Jeddah (SA)

(73) Assignee: SAUDI ARABIAN OIL COMPANY (SA)

( * ) Notice: Subject to any disclaimer, the term of this patent is extended or adjusted under 35 U.S.C. 154(b) by 0 days.

(21) Appl. No.: 16/388,154

(22) Filed: Apr. 18, 2019

(65) Prior Publication Data

US 2019/0241816 A1 Aug. 8, 2019

Related U.S. Application Data

(63) Continuation of application No. 15/682,079, filed on Aug. 21, 2017, now Pat. No. 10,308,880.

(51) Int. Cl.

| | |
|---|---|
| ***C10G 29/06*** | (2006.01) |
| ***B01J 23/16*** | (2006.01) |
| ***C10G 17/02*** | (2006.01) |
| ***C10G 17/10*** | (2006.01) |
| ***C10G 75/00*** | (2006.01) |
| *C10G 31/09* | (2006.01) |
| *C10G 31/10* | (2006.01) |

(52) U.S. Cl.

CPC ..... *C10G 17/02* (2013.01); *C10G 17/10* (2013.01); *C10G 75/00* (2013.01); *C10G 31/09* (2013.01); *C10G 31/10* (2013.01); *C10G 2300/206* (2013.01); *C10G 2300/208* (2013.01)

(58) Field of Classification Search

CPC .... C10G 29/06; C10G 2300/206; B01J 23/16; B01J 23/007; B01J 23/2219; B01J 23/00002

See application file for complete search history.

(56) References Cited

U.S. PATENT DOCUMENTS

| | | | | |
|---|---|---|---|---|
| 2,101,308 | A | 2/1932 | Bray et al. | |
| 2,337,448 | A | 1/1940 | Carr | |
| 2,367,671 | A | 11/1941 | Dickinson et al. | |
| 2,850,431 | A | 12/1955 | Smith | |
| 2,940,920 | A | 6/1960 | Garwin | |
| 3,159,571 | A | 12/1964 | Reman et al. | |
| 3,180,820 | A * | 4/1965 | Gleim | C10G 65/04 208/211 |
| 3,240,718 | A | 3/1966 | Gatsis | |
| 3,249,530 | A | 5/1966 | Gatsis | |
| 3,249,556 | A | 5/1966 | Gatsis | |
| 3,252,894 | A | 5/1966 | Gatsis | |
| 3,293,172 | A | 12/1966 | Gleim | |
| 3,331,769 | A | 7/1967 | Gatsis | |
| 3,364,138 | A | 1/1968 | Van Lookeren Campagne et al. | |
| 3,420,771 | A | 1/1969 | O'Hara et al. | |
| 3,813,329 | A | 5/1974 | Gatsis | |
| 3,825,488 | A | 7/1974 | Gatsis | |
| 4,101,415 | A | 7/1978 | Crowley | |
| 4,290,880 | A | 9/1981 | Leonard | |
| 4,548,711 | A | 10/1985 | Coombs et al. | |
| 5,171,727 | A * | 12/1992 | Gatsis | B01J 27/19 208/108 |
| 5,288,681 | A | 2/1994 | Gatsis | |
| 5,474,977 | A | 12/1995 | Gatsis | |
| 9,464,239 | B2 | 10/2016 | Nares Ochoa et al. | |
| 2013/0264247 | A1 | 10/2013 | Cardenas et al. | |
| 2015/0321975 | A1 | 11/2015 | Choi et al. | |
| 2017/0107433 | A1 | 4/2017 | Choi et al. | |

FOREIGN PATENT DOCUMENTS

KR 101472498 A 12/2017

OTHER PUBLICATIONS

H.-J. Eom et al., Hydrocracking of Extra-Heavy Oil Using Cs-Exchanged Phosphotungstic Acid (CsxH3-xPW12O40, x=1-3) Catalysts, 126 FUEL 263-270 (2014).*

The International Search Report and Written Opinion for related PCT application PCT/US2018/047240 dated Oct. 23, 2018. (SA5632).

Pelet, Resins and Asphaltenes in the Generation and Migration of Petroleum. Organic Geochemistry, Dec. 1986, vol. 10, Issues 1-3, pp. 481-498.

Payzant, Structural Units of Athabasca Asphaltene: The Aromatics With a Linear Carbon Framework. Energy Fuels 1991, vol. 5, pp. 445-453.

Mar. 31, 2012Ashtari, M.; Ashrafizadeh, S.N; Bayat, M.; Asphaltene Removal From Crude Oil by Means of Ceramic Membrances. Journal of Petroleum Science and Engineering, Feb.-Mar. 2012; vols. 82-83, pp. 44-49.

(Continued)

*Primary Examiner* — Randy Boyer

(74) *Attorney, Agent, or Firm* — Constance G. Rhebergen; Bracewell LLP

(57) ABSTRACT

A process for removing asphaltenes from an oil feed comprising the steps of introducing the oil feed to a reactor, where the oil feed comprises a carbonaceous material and asphaltenes, introducing a heteropolyacid feed to the reactor, where the heteropolyacid feed comprises a heteropolyacid, operating the reactor at a reaction temperature and a reaction pressure for a reaction time such that the heteropolyacid is operable to catalyze an acid catalyzed polymerization reaction of the asphaltenes to produce polymerized asphaltenes, where a mixed product comprises the polymerized asphaltenes and a de-asphalted oil, introducing the mixed product to a separator at the end of the reaction time, and separating the mixed product in the separator to produce a de-asphalted oil and a waste stream, where the de-asphalted oil has a lower concentration of sulfur, a lower concentration of nitrogen, and a lower concentration of metals as compared to the oil feed.

18 Claims, 6 Drawing Sheets

(56) References Cited

OTHER PUBLICATIONS

Liao, Discussion on the Structure Features of Asphaltene Molecules. Energy & Fuels 2009, vol. 23, pp. 6272-6274, 2009.
Abdel-Raouf, Crude Oil Emulsions: Composition Stability and Characterization. Rijeka, Croatia: InTech (2012).
Karimi, Quantitative Evidence for Bridged Structures in Asphaltenese by Thin Film Pyrolysis. Energy & Fuelds, 2011, vol. 25 (8), pp. 3581-3589.

* cited by examiner

NON-SOLVENT ASPHALTENE REMOVAL FROM CRUDE OIL USING SOLID HETEROPOLY COMPOUNDS

CROSS-REFERENCE TO RELATED APPLICATIONS

This patent application is a continuation of U.S. Non-Provisional patent application Ser. No. 15/682,079 filed on Aug. 21, 2017. For purposes of United States patent practice, the non-provisional application is incorporated by reference in its entirety.

TECHNICAL FIELD

Disclosed are methods for upgrading petroleum. Specifically, disclose are methods and systems for upgrading petroleum by removal of asphaltenes.

BACKGROUND

Asphaltenes are one of the four main constituents of crude oil, which also include saturates, aromatics, and resins. Asphaltenes impact virtually all aspects of the utilization of crude oils, and mostly have negative effects. For example, asphaltenes precipitation or deposition can occur in wellbores, pipelines, and surface facilities and is undesirable because it reduces well productivity and limits fluid flow. For refiners, asphaltenes cause concern because they can clog the refining system. Due to presence of sulfur, nitrogen and metals in the structures, asphaltenes can cause rapid catalyst deactivation during catalytic processing of crude oils. Therefore, asphaltenes are a cause of major economic, technical and safety problems during the production and processing of crude oils.

Given the operational problems caused by the presence of asphaltenes, separation of asphaltenes and other heavy species from crude oil is desirable. Solutions to address the operational problems of asphaltenes must address both problems of asphaltenes precipitation. And these solutions must improve the crude oil specifications including raising API gravity and decreasing crude oil viscosity. The API gravity and viscosity impact the price of crude oil.

One solution that addresses asphaltenes precipitation is the use of anti-scaling agents. Anti-scaling agents have been tested by researchers as a way to stabilize the asphaltenes suspensions in the crude oil, and by stabilizing the asphaltenes prevents precipitation during crude oil transportation and refining. However, asphaltenes decompose at high temperatures even with the use of anti-scaling agents, which can cause coke formation in heat exchanger and furnaces.

Another solution is hydrotreating the crude oil. Hydrotreating is a process that uses hydrogen to convert compounds in the crude oil. Hydrotreating requires high temperatures and high pressures which results in a process that is energy intensive. In addition, hydrotreating requires expensive catalyst. The use of hydrogen poses a risk of hydrogen explosion. Finally, tail gas from a hydrotreater cannot be directly released to the atmosphere, requiring some type of tail gas exhaust treatment.

Conventional asphaltene separation technology, generally referred to as solvent de-asphalting (SDA), involves the application of paraffinic solvents. SDA processes are based on liquid-liquid extraction using paraffinic solvents. SDA technology is considered one of the most efficient approaches to reduce asphaltenes and metal content of crude oil and heavy oil cuts to produce higher-value de-asphalted oil (DAO). SDA processes offer the advantages of low installation cost and flexibility in terms of the ability to control the quality of asphaltenes and DAO. However, the SDA process requires a considerable amount of expensive paraffinic solvents (the paraffinic solvent to crude oil ratio is typically from 2:1 to 10:1 by volume). The paraffinic solvent type directly decides the yield and quality of DAO; as the carbon number of the paraffinic solvent increases, the yield of recovered DAO will increase, but the quality of DAO will be reduced. Furthermore, the separation and recovery of paraffinic solvents from DAO are energy-intensive processes. Solvent recovery through a distillation process is not possible due to the wide range of boiling points of crude oil components, so a more complex solvent recovery technique, such as single-effect evaporation, double-effect evaporation, or triple-effect evaporation is needed. The large amount of waste paraffinic solvents is also another drawback of SDA.

SUMMARY

Disclosed are methods for upgrading petroleum. Specifically, disclose are methods and systems for upgrading petroleum by removal of asphaltenes.

In a first aspect, a process for removing asphaltenes from an oil feed is provided. The process includes the steps of introducing the oil feed to a reactor, the oil feed includes a carbonaceous material and asphaltenes, introducing a heteropolyacid feed to the reactor, the heteropolyacid feed includes a heteropolyacid, operating the reactor at a reaction temperature and a reaction pressure for a reaction time such that the heteropolyacid is operable to catalyze an acid catalyzed polymerization reaction of the asphaltenes to produce polymerized asphaltenes. A mixed product includes the polymerized asphaltenes and a de-asphalted oil. The process further includes the steps of introducing the mixed product to a cooling unit at the end of the reaction time, reducing the temperature of the mixed product in the cooling unit to produce a cooled product, introducing the cooled product to a separator, and separating the cooled product in the separator to produce a de-asphalted oil and a waste stream, where the de-asphalted oil has a lower concentration of sulfur, a lower concentration of nitrogen, and a lower concentration of metals as compared to the oil feed.

In certain aspects, the process further includes the step of separating the waste stream into a recovered heteropolyacids and a recovered asphaltenes. In certain aspects, the carbonaceous material can be selected from the group consisting of crude oil, heavy crude oil, light crude oil, vacuum residue streams, and atmospheric distillation streams. In certain aspects, the concentration of asphaltenes in the oil feed is between 1% by weight and 20% by weight. In certain aspects, the heteropolyacid is selected from the group consisting of Keggin-type heteropolyacids, cesium substituted heteropolyacids, and combinations of the same. In certain aspects, the Keggin-type heteropolyacid is selected from the group consisting of phosphortungstic heteropolyacid ($H_3PW_{12}O_{40}$), phosphormolybdic heteropolyacid ($H_3PMo_{12}O_{40}$), silicotungstic heteropolyacid ($H_4SiW_{12}O_{40}$) silicomolybdic heteropolyacid ($H_4SiMo_{12}O_{40}$), and combinations of the same. In certain aspects, the cesium substituted heteropolyacid is selected from the group consisting of $Cs_xH_yPMo_{12}O_{40}$, $Cs_xH_yPW_{12}O_{40}$, $Cs_xH_ySiMo_{12}O_{40}$ and $Cs_xH_ySiW_{12}O_{40}$, in which $0<x<4$. In certain aspects, the reaction temperature is between 20 deg C. and 100 deg C. In certain aspects, the reaction pressure is atmospheric pressure. In certain aspects, the reaction time is between 3 hours and 5 hours. In certain aspects, the separator is a centrifuge.

In certain aspects, the de-asphalted oil contains less than 1% by weight asphaltenes. In certain aspects, the process further includes the step of introducing the de-asphalted oil to an upgrading reactor to produce an upgraded product. In certain aspects, the process further includes the steps of introducing the oil feed and the heteropolyacid feed to a mixer to produce a mixed feed prior to the steps of introducing the oil feed to the reactor and introducing a heteropolyacid feed to the reactor, and introducing the mixed feed to the reactor.

In a second aspect, a system for removing asphaltenes from an oil feed is provided. The system includes a reactor configured to operate at a reaction pressure, a reaction temperature, and for a reaction time such that an acid catalyzed polymerization reaction of asphaltenes in the oil feed occurs to produce a polymerized asphaltenes in a mixed product. The system further includes a cooling unit fluidly connected to the reactor, the cooling unit configured to reduce the temperature of the mixed product to produce a cooled product, and a separator fluidly connected to the cooling unit, the separator configured to separate the cooled product into a de-asphalted oil and a waste stream, where the waste stream includes the polymerized asphaltenes.

In certain aspects, the system further includes a mixer upstream of the reactor and fluidly connected to the reactor, where the mixer is configured to mix the oil feed and the heteropolyacid feed to produce a mixed feed. In certain aspects, the system further includes an upgrading reactor fluidly connected to the separator, the upgrading reactor configured to upgrade the de-asphalted oil. In certain aspects, the system further includes an asphaltene recovery unit fluidly connected to the separator, the asphaltene recovery unit configured to separate the waste stream into a recovered heteropolyacids and a recovered asphaltenes.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

DETAILED DESCRIPTION

Figure 1:
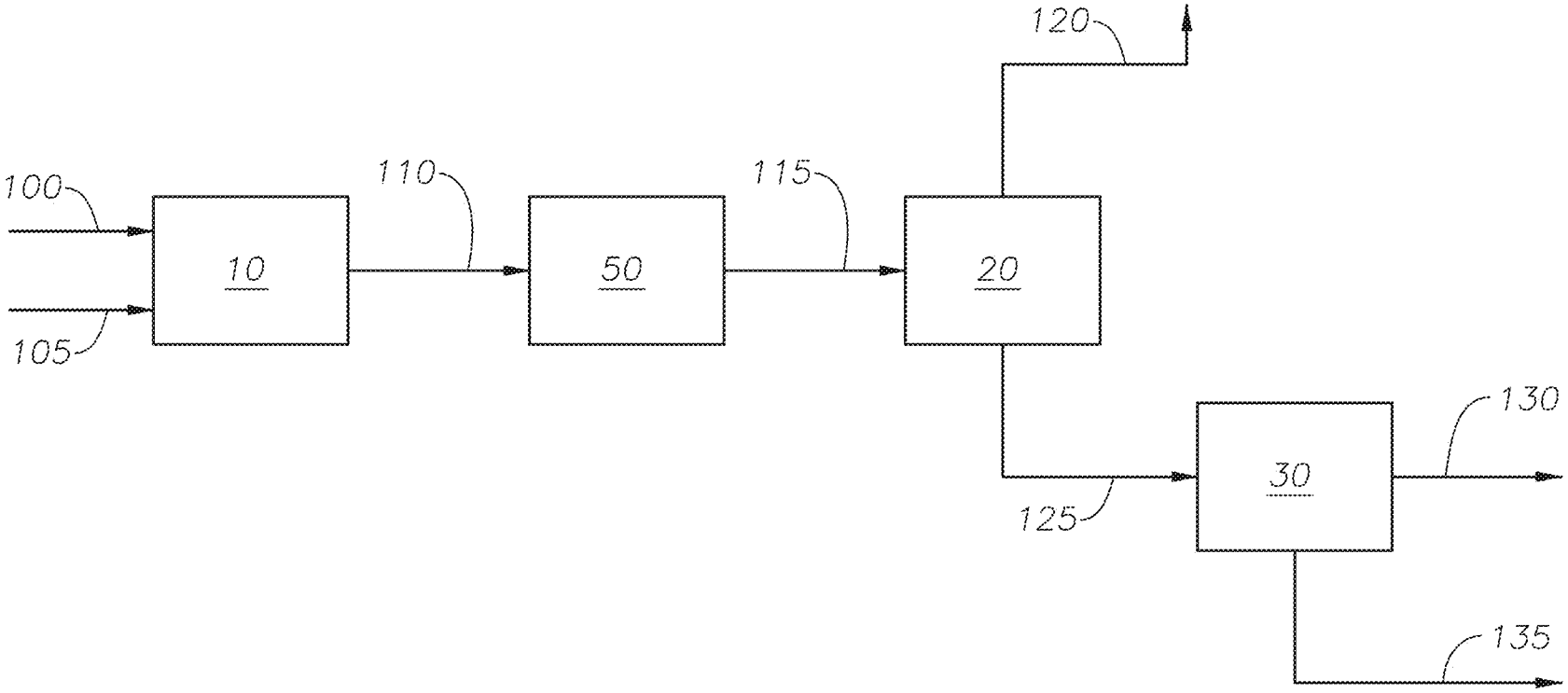
FIG. 1 provides a process diagram of an embodiment of the process.

While the scope will be described with several embodiments, it is understood that one of ordinary skill in the relevant art will appreciate that many examples, variations and alterations to the apparatus and methods described herein are within the scope and spirit. Accordingly, the embodiments described are set forth without any loss of generality, and without imposing limitations, on the embodiments. Those of skill in the art understand that the scope includes all possible combinations and uses of particular features described in the specification.

Described here are processes and systems for the removal of asphaltenes from a petroleum stream. Advantageously, the processes and systems described are in the absence of paraffinic solvents, which avoids the generation of solvent waste. Advantageously, the processes and systems described remove asphaltenes under mild conditions which reduces the production of coke. Advantageously, the processes and systems described operate at low temperatures and atmospheric pressures resulting in a process which consumes less energy as compared to other processes to remove asphaltenes. Advantageously, the processes and systems described provide for removal of asphaltenes in the absence of the deactivation of catalysts.

As used throughout, "asphaltenes" refers to a mix of high molecular weight polycyclic aromatic hydrocarbons, which consist primarily of carbon, hydrogen, nitrogen, oxygen and sulfur with trace amounts of metals such as vanadium and nickel, and a hydrogen to carbon ratio of about 1.2 to 1. Operationally, asphaltenes refers to the n-heptane-insoluble, toluene soluble component of a carbonaceous material. Asphaltenes are the sticky, black, highly viscous residue of distillation processes. Asphaltenes contain highly polar species that tend to associate or aggregate, which has made complete molecular analysis of asphaltenes, for example by mass spectrometry, difficult.

As used throughout, "heteropoly compounds" or "heteropolyoxomatalates" or "polyoxometalates" refers to solid compounds that have discrete anionic units of metal oxides as metal-oxygen polyhedron units organized by at least one central atom being referred to as the heteroatom. Heteroatoms can include silicon in the oxidation state +4 ($Si^{4+}$), germanium in the oxidation state +4 ($Ge^{4+}$), phosphorous in the oxidation state +5 ($P^{5+}$), arsenic in the oxidation state +5 ($As^{5+}$), boron in the oxidation state +3 ($B^{3+}$). The primary metal-oxygen polyhedron units form a secondary structure by being associated with interstitial guest species, such as water, alcohols, ethers, amines, and cesium. Aggregations of these secondary structures form a tertiary structure that dictates the physical characteristics of the material, such as, for example, porosity, particle size, and surface area. Metal oxides and zeolites are not heteropoly compounds, as metal oxides and zeolites have metal oxygen lattices. Heteropoly compounds include heteropolyacids, their salts, and compounds derived from them that maintain essentially the heteropolyanion structure. Heteropoly compounds can be stable at temperatures up to 400 degrees Celsius (deg C.).

As used throughout, "heteropolyacids" are a type of heteropoly compound. Examples of heteropolyacids include Keggin-type heteropolyacids, cesium substituted heteropolyacids, and combinations of the same. Keggin-type heteropolyacids can include phosphortungstic heteropolyacid ($H_3PW_{12}O_{40}$), phosphormolybdic heteropolyacid ($H_3PMo_{12}O_{40}$), silicotungstic heteropolyacid ($H_4SiW_{12}O_{40}$) silicomolybdic heteropolyacid ($H_4SiMo_{12}O_{40}$), and combinations of the same. Cesium substituted heteropolyacids can include $Cs_xH_yPMo_{12}O_{40}$, $Cs_xH_yPW_{12}O_{40}$, $Cs_xH_ySiMo_{12}O_{40}$ and $Cs_xH_ySiW_{12}O_{40}$, in which $0<x<4$ and y equals 4−x when the heteroatom is tungsten (W) and y equals 3−x when the heteroatom is molybdenum (Mo) and combinations of the same. Keggin-type heteropolyacids can be water-soluble. Cesium substituted heteropolyacids can be water insoluble.

As used throughout, "paraffinic solvent" refers to n-paraffins having between three carbon atoms and seven carbon atoms inclusive. Paraffinic solvents can include n-propane, n-butane, n-pentane, n-hexane, n-heptane, and combinations thereof.

As used throughout, "de-asphalted oil" refers to a petroleum stream containing less than 1 percent (%) by weight asphaltenes, alternately less than 0.5% by weight asphaltenes, and alternately 0% by weight asphaltenes. De-asphalted oil contains a lower concentration of sulfur compounds, nitrogen compounds, and metals as compared to the carbonaceous material in the feed stream to the reactor.

As used throughout, "gas environment" refers to a gas being introduced to the head space in the reactor and filling the open volume on top of the liquid level.

Referring to FIG. 1, oil feed 100 and heteropolyacid feed 105 can be introduced to reactor 10.

Oil feed 100 can be any carbonaceous material containing asphaltenes. Carbonaceous materials containing asphaltenes can include crude oil, heavy crude oil, light crude oil, vacuum residue streams, atmospheric distillation streams, pyrolysis oil from a steam cracking process, and combinations of the same. The concentration of asphaltenes in oil feed 100 can be between 1% by weight and 20% by weight, alternately between 1% by weight and 17% by weight, alternately less than 5% by weight, and alternately between 15% by weight and 20% by weight. In at least one embodiment, oil feed 100 is a light crude oil with a concentration of asphaltenes of less than 5% by weight. In at least one embodiment, oil feed 100 is a heavy crude oil with a concentration of asphaltenes between 15% by weight and 20% by weight. Precipitation of asphaltenes in light crude oils is often observed because even though the light crude oils have low concentrations of asphaltenes, the light crude oils contain high amounts of light alkanes in which asphaltenes have limited solubility.

Reactor 10 can be any reactor unit capable of facilitating a batch reaction. Examples of reactor 10 include tank units. In at least one embodiment, reactor 10 is a tank reactor with an agitation unit capable of facilitating a batch reaction. Reactor 10 can be under a gas environment. Examples of gases suitable for use in the gas environment include, air, oxygen, nitrogen, argon, and other inert gases. In at least one embodiment, reactor 10 can be under an air environment. Reactor 10 can operate at a reaction pressure, a reaction temperature, and for a reaction time. The reaction pressure can be at atmospheric pressure. The reaction temperature can be between room temperature and 100 deg C., alternately between 20 deg C. and 100 deg C., alternately between 25 deg C. and 100 deg C., alternately between 30 deg C. and 90 deg C., alternately between 40 deg C. and 80 deg C., alternately between 50 deg C. and 70 deg C., and alternately between 55 deg C. and 65 deg C. In at least one embodiment, the reaction temperature is between 55 deg C. and 65 deg C. The reaction time can be between 1 hour and 5 hours, alternately between 3 hours and 5 hours. The reaction temperature and the reaction time can be designed and adjusted based on the type of carbonaceous material in oil feed 100 and the type of heteropolyacid in heteropolyacid feed 105. Reactor 10 is in the absence of a paraffinic solvent. Reactor 10 is in the absence of water.

Figure 2:
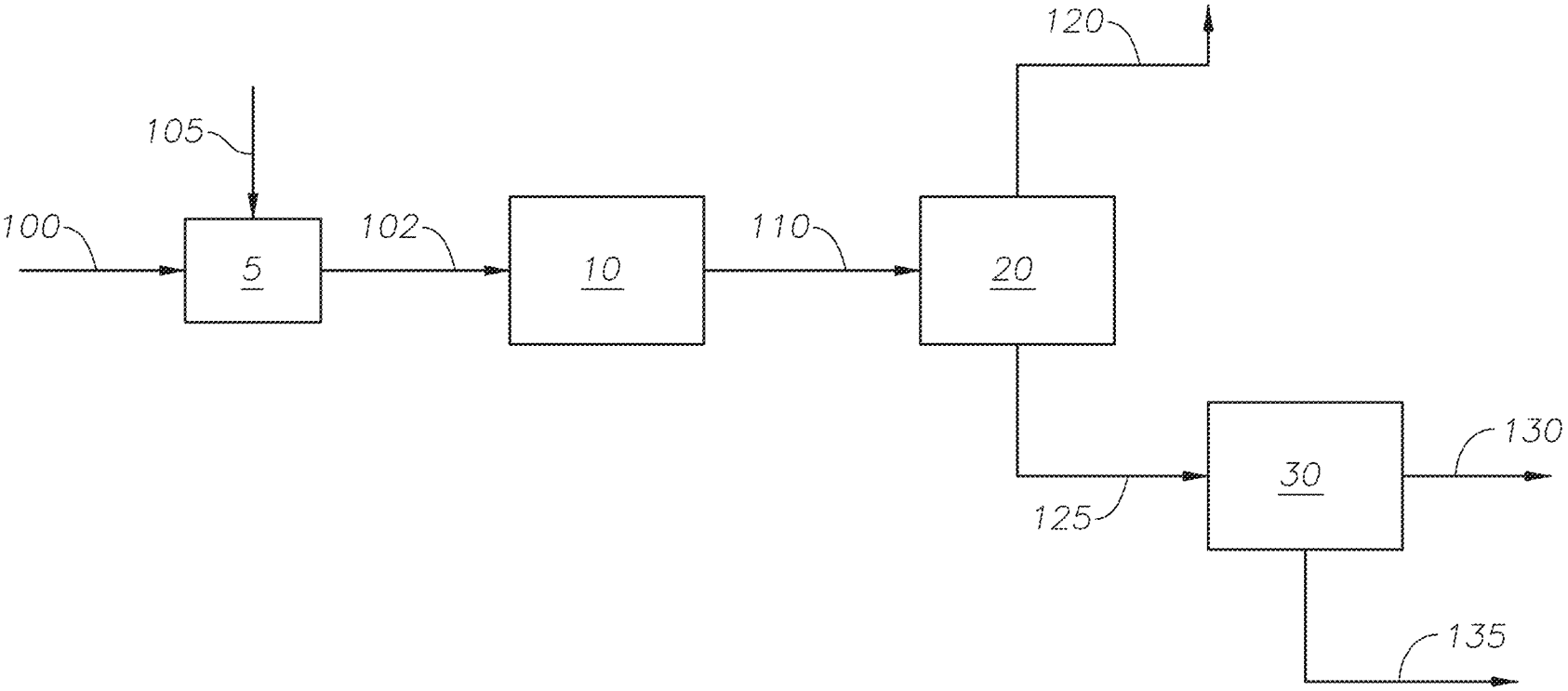
FIG. 2 provides a process diagram of an embodiment of the process.
Figure 3:
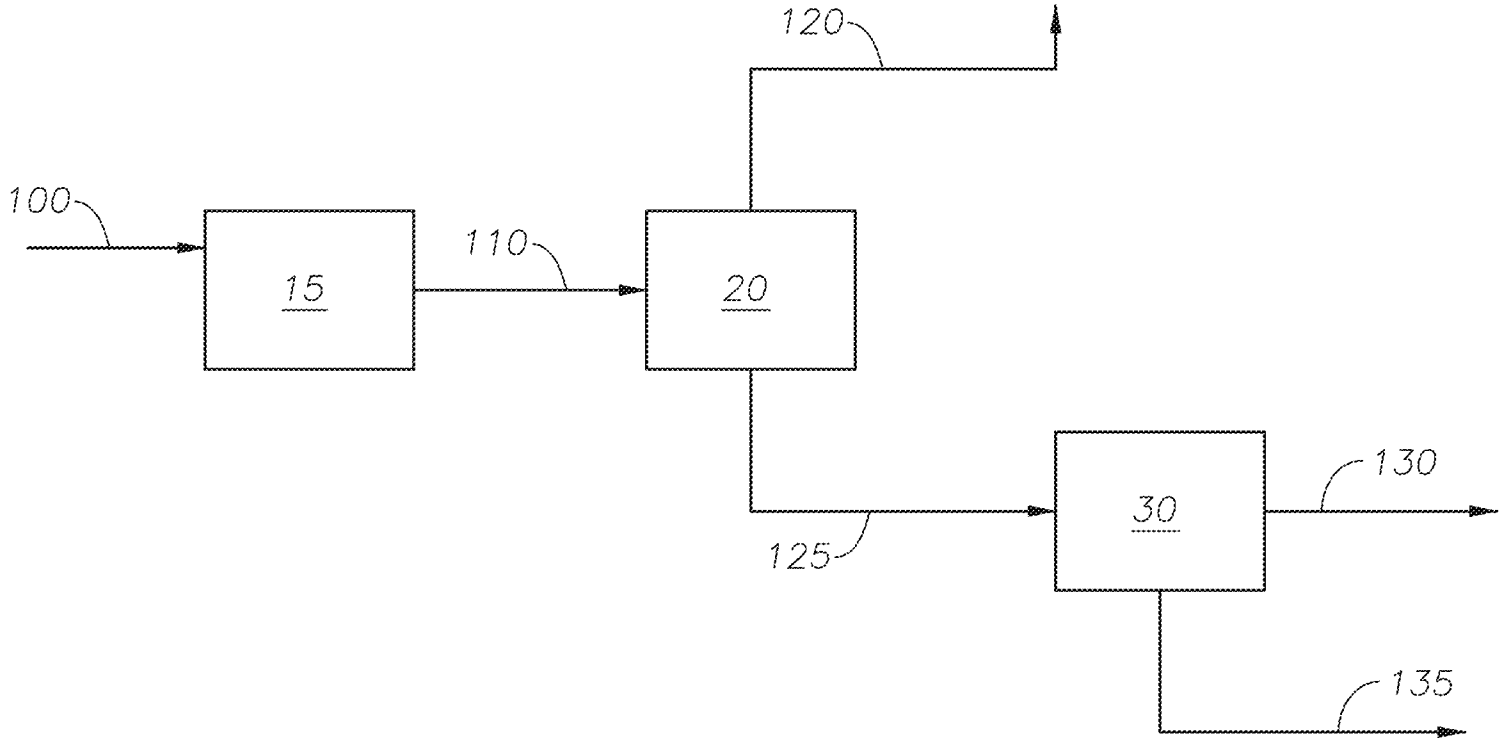
FIG. 3 provides a process diagram of an embodiment of the process.

Heteropolyacid feed 105 can include a heteropolyacid. Heteropolyacid feed 105 can include the dry solid heteropolyacid and be in the absence of a carrier liquid. Heteropolyacid feed 105 can include Keggin-type heteropolyacids, cesium substituted heteropolyacids, and combinations of the same. As shown in FIG. 1, heteropolyacid feed 105 can be introduced to reactor 10. In at least one embodiment, heteropolyacid feed 105 can be introduced to reactor 10 with use of a hopper. In at alternate embodiment, with reference to FIG. 2, oil feed 100 and heteropolyacid feed 105 can be introduced to mixer 5 upstream of reactor 10. Mixer 5 can be any unit capable of mixing a petroleum stream and a solids stream. Mixer 5 can produce mixed feed 102 which can be introduced to reactor 10. In an alternate embodiment, with reference to FIG. 3, the heteropolyacids can be added to charged reactor 15 prior to oil feed 100, such that prior to the beginning of the reaction time charged reactor 15 contains heteropolyacids. At the beginning of the reaction time, oil feed 100 is introduced to charged reactor 15. Charged reactor 15 can have the same reaction temperature, reaction pressure, and reaction time as described with reference to reactor 10. Charged reactor 15 is in the absence of paraffinic solvent. In at least one embodiment, at the end of the reaction time, the entire contents of charged reactor 15, including the heteropolyacids can be removed in mixed product 110. The ratio of oil feed 100 to heteropolyacid feed 105 can be 10 to 1 on a volume basis, and alternately 8.33 to 1 on a volume basis. At ratios outside of this range, the feed conversion and product distribution can impact the speed of reaction.

In reactor 10 and charged reactor 15, the heteropolyacids serve as a catalyst for an acid catalyzed polymerization reaction of the asphaltenes to produced polymerized asphaltenes.

Returning to FIG. 1, mixed product 110 can exit reactor 10 at the end of the reaction time. Mixed product 110 contains de-asphalted oil, polymerized asphaltenes, asphaltenes and used heteropolyacids. The polymerized asphaltenes can be suspended in mixed product 110. Mixed product 110 can be introduced to cooling unit 50.

Figure 4:
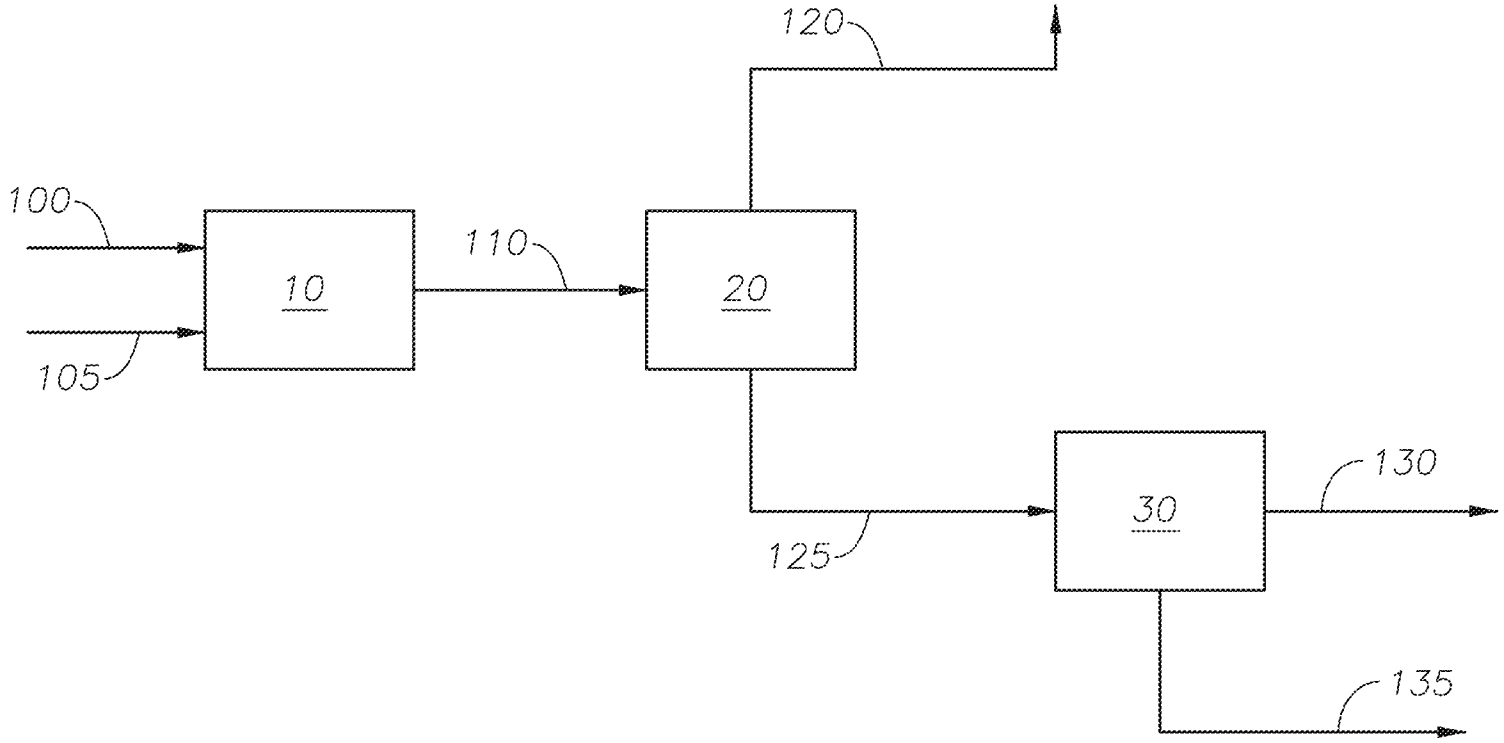
FIG. 4 provides a process diagram of an embodiment of the process.

Cooling unit 50 can be any type of heat exchanger capable of reducing the temperature of mixed product 110 to produce cooled product 115. Cooled product 115 can have a temperature between room temperature and 75 deg C., alternately between 20 deg C. and 75 deg C., alternately between 20 deg C. and 70 deg C., alternately between 20 deg C. and 60 deg C., alternately between 20 deg C. and 50 deg C., alternately between 20 deg C. and 40 deg C., alternately between 20 deg C. and 30 deg C., alternately between 20 deg C. and 25 deg C., and alternately between 25 deg C. and 30 deg C. In at least one embodiment, the temperature cooled product 115 is 25 deg C. In at least one embodiment, the system for the removal of asphaltenes from a petroleum stream is in the absence of a cooling unit as shown in FIG. 4, and mixed product 110 is introduced directly to product separator 20. Cooled product 115 can be introduced to product separator 20.

Figure 5:
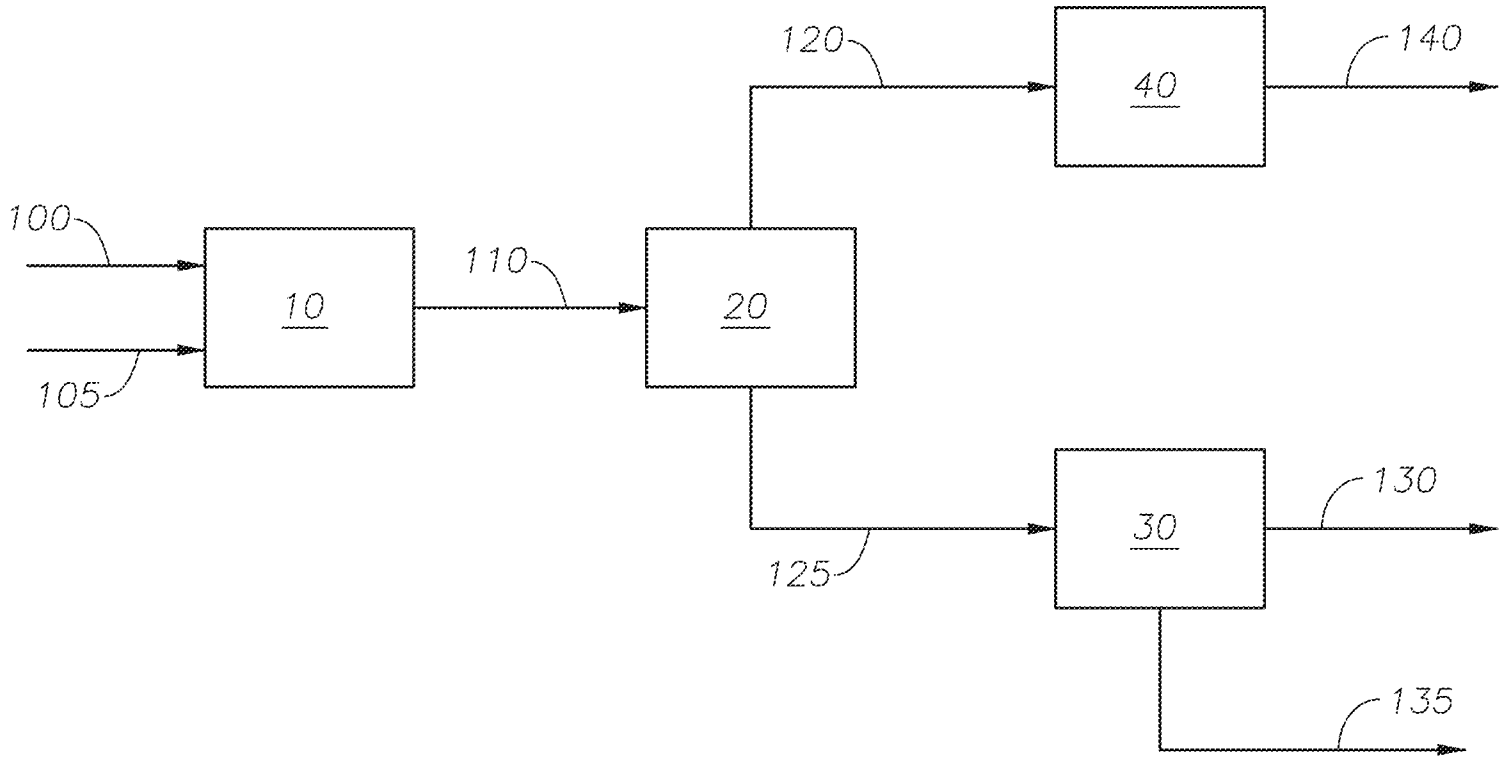
FIG. 5 provides a process diagram of an embodiment of the process.

Product separator 20 can be any type of separation unit capable of separating de-asphalted oil from cooled product 115 to produce de-asphalted oil 120 and waste stream 125. In at least one embodiment, product separator 20 is a centrifuge that separates de-asphalted oil to produce de-asphalted oil 120. In at least one embodiment, product separator 20 includes a membrane filtration separator. De-asphalted oil 120 contains de-asphalted oil with a lower concentration of sulfur, lower concentration of nitrogen, and lower concentration of metals as compared to the carbonaceous material in oil feed 100. De-asphalted oil 120 has a lower viscosity relative to oil feed 100. De-asphalted oil 120 can be further processed. In at least one embodiment, as shown with reference to FIG. 5, de-asphalted oil 120 can be introduced to upgrading reactor 40 to produce upgraded product 140. Upgrading reactor 40 can include a catalytic cracker. In at least one embodiment, upgrading reactor 40 is a catalytic cracker and upgraded product 140 includes light olefins and light aromatics. De-asphalted oil 120 can be sent to storage or combined with other oil streams.

Returning to FIG. 1, waste stream 125 can be introduced to asphaltene recovery unit 30. Waste stream 125 contains polymerized asphaltenes, asphaltenes, and used heteropolyacids. Asphaltene recovery unit 30 can be any type of batch unit capable of dissolving the polymerized asphaltenes and the asphaltenes in a solvent to create an asphaltene solution. The asphaltene solution contains the solvent and the dissolved polymerized asphaltenes and the asphaltenes. The used heteropolyacids do not dissolve in the solvent, so the used heteropolyacids can be separated from the asphaltene solution. In at least one embodiment, asphaltene recovery unit 30 can include a centrifuge or filtration to separate the used heteropolyacids from the asphaltene solution. In at least one embodiment, the solvent in asphaltene recovery unit 30 is toluene. The used toluene can then be evaporated leaving behind recovered asphaltenes. The recovered asphaltenes can have a jelly like consistency. The recovered asphaltenes can include polymerized asphaltenes, asphaltenes, and combinations of the same. Asphaltene recovery unit 30 can separate waste stream 125 to produce recovered heteropolyacids 130 and recovered asphaltenes 135. Recovered heteropolyacids 130 contains the used heteropolyacids. In at least one embodiment, recovered heteropolyacids 130 can be subjected to an additional wash with toluene to further purify the used heteropolyacids and the purified heteropolyacids can be recycled to reactor 10. Advantageously, the used heteropolyacids sustain the same structure as the heteropolyacids in heteropolyacid feed 105. Recovered asphaltenes 135 contains the recovered asphaltenes. Recovered asphaltenes contains both polymerized asphaltenes and asphaltenes. In at least one embodiment, the recovered asphaltenes can contain an amount of heteropolyacids less than 10% by weight, alternately less than 5% by weight, alternately less than 1% by weight, and alternately 0% by weight. In at least one embodiment, recovered asphaltenes 135 is in the absence of heteropolyacids. Recovered asphaltenes 135 can be collected and further processed to make asphaltene-based products, such as fibers.

The process and system to remove asphaltenes can be positioned at a drill site to treat petroleum produced from a well or can be added to an existing refinery process upstream of an upgrading unit, such as a catalytic cracking unit, an FCC unit, a reforming unit, or a dehydrogenation process. The process and system is in the absence of added hydrogen gas

EXAMPLES

Example 1

Example 1 tested the ability of the heteropolyacids to separate asphaltenes. The heteropolyacids $H_3PW_{12}O_{40}$, $H_3PMo_{12}O_{40}$, $H_4SiW_{12}O_{40}$ and $H_4SiMo_{12}O_{40}$ were purchased from Sigma-Aldrich® (St. Louis, Mo.). The cesium substituted heteropolyacids, $Cs_xH_yPMo_{12}O_{40}$, $Cs_xH_yPW_{12}O_{40}$, $Cs_xH_ySiMo_{12}O_{40}$ and $Cs_xH_ySiW_{12}O_{40}$, in which $0<x<4$, were prepared according to the following procedure: The required amount of aqueous cesium carbonate (0.06 molar (M)) was added dropwise to an aqueous solution of a heteropolyacid (0.06 M) at 323 Kelvin (K) under agitation. The cesium substitute heteropolyacids precipitated from the solution and were recovered by filtration followed by washing with deionized water and drying by air. The recovered powder was calcined in air at 473K for two hours. All of the heteropolyacids were dehydrated at 100 deg C.

Figure 6:
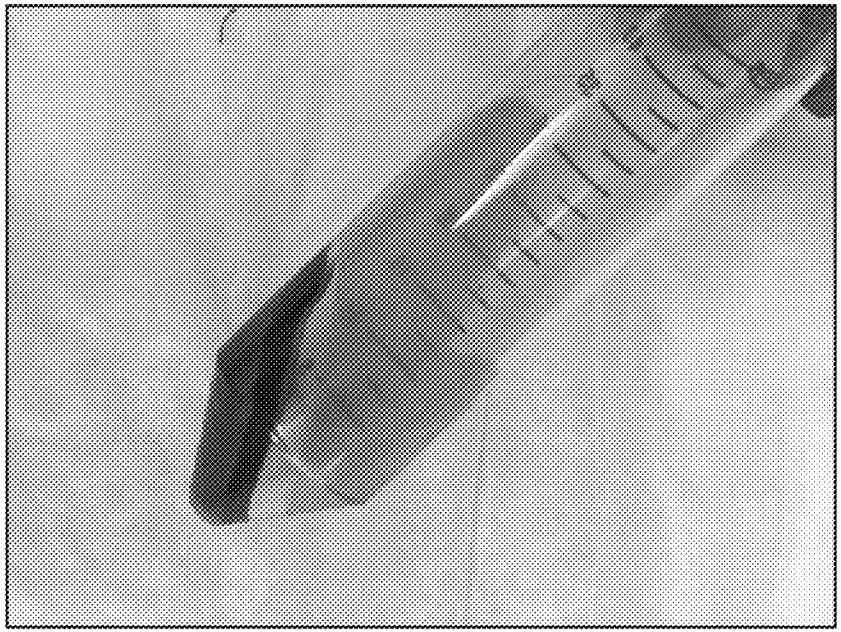
FIG. 6 is a pictorial representation of the centrifuge tube of Example 1.
Figure 7:
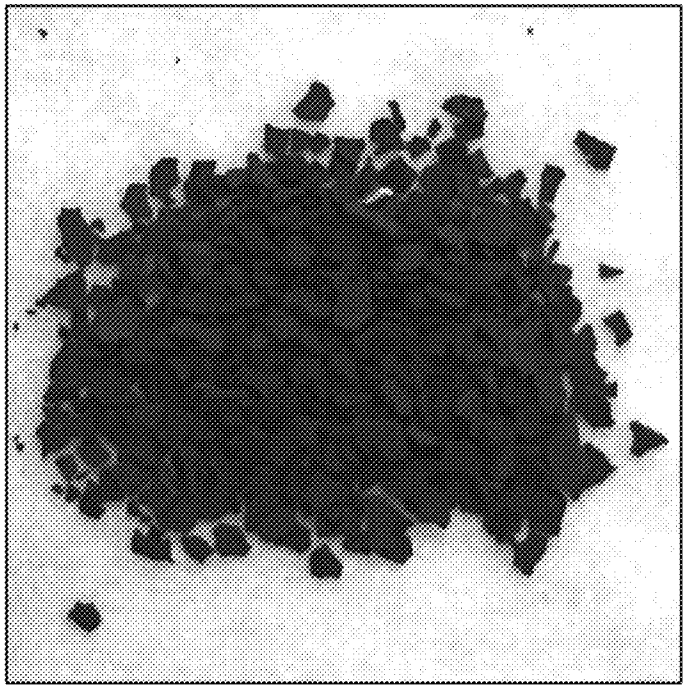
FIG. 7 is a pictorial representation of the dried recovered asphaltene of Example 1.

A benchtop process was employed, the reactor was a batch reactor with an agitator and the separator was a centrifuge. The oil feed was 5 milliliters (mL) of an Arabian light crude oil. Various properties of the oil are shown in Table 1 as determined by inductively coupled plasma mass spectrometry (ICP), x-ray fluorescence spectroscopy (XRF), and elemental CHNSO analysis. The heteropolyacids was 1 gram of $H_3PW_{12}O_{40}$. The oil and the heteropolyacids were added to the reactor at the same time. The reaction temperature in the reactor was 60 deg C. The reaction pressure in the reactor was atmospheric pressure. The reactor was under air. The reaction time was 3 hours. At the conclusion of the reaction time, the mixed product was allowed to cool and was then transferred to a centrifuge tube. The cooling time prevented the light components present in de-asphalted oil from evaporating when the reactor was opened. The centrifuge tube was placed in the separator and centrifuged at 10,000 revolutions per minute (rpm) for 20 minutes. Three layers were obtained in the centrifuge after centrifuging in the separator, see FIG. 6. The top layer contained the de-asphalted oil. The middle layer contained polymerized asphaltenes and asphaltenes. The bottom layer contained the recovered heteropolyacids. Polymerized asphaltenes and asphaltenes present in the recovered heteropolyacids were removed by washing the mixture with toluene. The asphaltene solution was then vacuum dried at room temperature and then at 100 deg C. overnight. The resulting recovered asphaltenes solids are shown in FIG. 7. The recovered heteropolyacids was vacuum dried at room temperature and then at 100 deg C. overnight. Various properties of the dried recovered asphaltenes and the de-asphalted oil are in Table 1.

TABLE 1

Properties of various streams

| Property | Arabian Light Crude Oil | Recovered asphaltenes | De-asphalted Oil | Arabian Extra Light Crude Oil |
|---|---|---|---|---|
| Hydrogen to Carbon Ratio | 1.81 to 1 | 1.22 to 1 | 1.84 to 1 | NA |
| Viscosity, cP at 25 deg C. | 59.07 | N/A | 10.8 | 39.2 |
| Sulfur, % by weight | 1.83 | 3.47 | 1.06 | 1.1 |
| Nitrogen, ppmw* | 1626 | 5157 | 891 | 304 |
| Nickel, ppmw | 3.90 | 51.59 | 1.26 | <1 |
| Vanadium, ppmw | 11.96 | 214.18 | 2.24 | 2 |
| Asphaltenes, % by weight | 3.5 | 100 | Less than 0.5 | NA |
| DAO yield, volume % | N/A | N/A | 83.3 | NA |

*part-per-million by weight

As shown in Table 1, the de-asphalted oil had a lower viscosity, lower sulfur concentration, lower nitrogen concentration and lower metals concentration as compared to the oil feed. The hydrogen to carbon ratio in the dried precipitated asphaltenes of 1.22 to 1 is consistent with the established hydrogen to carbon ratio values for asphaltenes. Comparing the de-asphalted oil to an Arabian extra light crude oil it can be seen that the de-asphalted oil has a lower viscosity, similar sulfur and metals content, and the nitrogen content is higher.

Example 2

Example 2 was a comparative example. The reactor and the separator were the same as used in Example 1. The oil feed was 5 mL of the same light crude oil as used in Example 1. The reactor was in the absence of heteropolyacids. The reaction conditions, reaction temperature, reaction pressure, and reaction time, were the same as in Example 1. After cooling, the reaction product was removed from the reactor and placed in a centrifuge tube and centrifuged in the separator at 10,000 rpm for 20 minutes. No asphaltene precipitation was observed after the reaction.

Example 3

Example 3 was a comparative example. The reactor and the separator were the same as used in Example 1. The feed oil was 5 mL of the same light crude oil as used in Example 1. The feed oil and 20 mL of 99% sulfuric acid were added to the reactor. The reaction conditions, reaction temperature, reaction pressure, and reaction time, were the same as in Example 1. After cooling, the reaction product was removed from the reactor and placed in a centrifuge tube and centrifuged in the separator at 10,000 rpm for 20 minutes. No asphaltene precipitation was observed after the reaction.

Comparing Example 1 to Examples 2 and 3, shows that heteropolyacids can remove asphaltenes from crude oil in the absence of paraffinic solvents, while other inorganic acids cannot.

Although described in detail, it should be understood that various changes, substitutions, and alterations can be made hereupon without departing from the principle and scope. Accordingly, the scope should be determined by the following claims and their appropriate legal equivalents. There various elements described can be used in combination with all other elements described herein unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope.

That which is claimed is:

1. A process for removing asphaltenes from an oil feed, the process comprising the steps of:

introducing the oil feed to a charged reactor, where the oil feed comprises a carbonaceous material and asphaltenes, wherein the charged reactor comprises a heteropolyacid;

operating the charged reactor at a reaction temperature and a reaction pressure for a reaction time such that the heteropolyacid is operable to catalyze an acid catalyzed polymerization reaction of the asphaltenes to produce polymerized asphaltenes, where a mixed product comprises the polymerized asphaltenes and a de-asphalted oil, wherein the charged reactor is in the absence of water;

introducing the mixed product to a separator at the end of the reaction time; and separating the mixed product in the separator to produce a de-asphalted oil and a waste stream, where the de-asphalted oil has a lower concentration of sulfur, a lower concentration of nitrogen, and a lower concentration of metals as compared to the oil feed, wherein the process for removing asphaltenes is in the absence of added hydrogen gas.

2. The process of claim 1, further comprising the step of separating the waste stream into a recovered heteropolyacid and an recovered asphaltenes.

3. The process of claim 1, where the carbonaceous material can be selected from the group consisting of crude oil, heavy crude oil, light crude oil, vacuum residue streams, and atmospheric distillation streams.

4. The process of claim 1, where the concentration of asphaltenes in the oil feed is between 1% by weight and 20% by weight.

5. The process of claim 1, where the heteropolyacid is selected from the group consisting of Keggin-type heteropolyacids, cesium substituted heteropolyacids, and combinations of the same.

6. The process of claim 5, wherein the Keggin-type heteropolyacid is selected from the group consisting of phosphotungstic heteropolyacid ($H_3PW_{12}O_{40}$), phosphormolybdic phosphomolybdic heteropolyacid ($H_3PMo_{12}O_{40}$), silicotungstic heteropolyacid ($H_4SiW_{12}O_{40}$), silicomolybdic heteropolyacid ($H_4SiMo_{12}O_{40}$), and combinations of the same.

7. The process of claim 5, where the cesium substituted heteropolyacid is selected from the group consisting of $Cs_xH_yPMo_{12}O_{40}$, in which $0<x<4$ and y equals 3−x, $Cs_xH_yPW_{12}O_{40}$, in which $0<x<4$ and y equals 4-x, $Cs_xH_ySiMo_{12}O_{40}$, in which $0<x<4$ and y equals 3−x, and $Cs_xH_ySiW_{12}O_{40}$, in which $0<x<4$ and y equals 4−x.

8. The process of claim 1, where the reaction temperature is between 20 deg C. and 100 deg C.

9. The process of claim 1, where the reaction pressure is atmospheric pressure.

10. The process of claim 1, where the reaction time is between 3 hours and 5 hours.

11. The process of claim 1, where the separator is a centrifuge.

12. The process of claim 1, where the de-asphalted oil contains less than 1% by weight asphaltenes.

13. The process of claim 1, further comprising the step of introducing the de-asphalted oil to an upgrading reactor to produce an upgraded product.

14. The process of claim 1, further comprising the steps of:

introducing the mixed product to a cooling unit at the end of the reaction time;

reducing the temperature of the mixed product in the cooling unit to produce a cooled product;

introducing the cooled product to the separator.

15. A system for removing asphaltenes from an oil feed, the system comprising:

a charged reactor, the reactor configured to operate at a reaction pressure, a reaction temperature, and for a reaction time such that an acid catalyzed polymerization reaction of asphaltenes in the oil feed occurs to produce a polymerized asphaltenes in a mixed product, wherein the charged reactor is in the absence of water, wherein the charged reactor comprises a heteropolyacid; and a separator fluidly connected to the charged reactor, the separator configured to separate the mixed product into a de-asphalted oil and a waste stream, where the waste stream comprises the polymerized asphaltenes, wherein the system for removing asphaltenes from an oil feed is in the absence of added hydrogen gas.

16. The system of claim 15, further comprising an upgrading reactor fluidly connected to the separator, the upgrading reactor configured to upgrade the de-asphalted oil.

17. The system of claim 15, further comprising an asphaltene recovery unit fluidly connected to the separator, the asphaltene recovery unit configured to separate the waste stream into a recovered heteropolyacids and a recovered asphaltene.

18. The system of claim 15, further comprising a cooling unit fluidly connected between the charged reactor and the separator, the cooling unit configured to reduce the temperature of the mixed product to produce a cooled product, wherein the cooled product is introduced to the separator.

* * * * *